US012448673B2

(12) United States Patent
Harding

(10) Patent No.: US 12,448,673 B2
(45) Date of Patent: Oct. 21, 2025

(54) AUSTENITIC STAINLESS ALLOY WITH SUPERIOR CORROSION RESISTANCE

(71) Applicant: CHEMETICS INC., Vancouver (CA)

(72) Inventor: Grant Harding, Whitby (CA)

(73) Assignee: CHEMETICS INC., Vancouver (CA)

( * ) Notice: Subject to any disclaimer, the term of this patent is extended or adjusted under 35 U.S.C. 154(b) by 0 days.

(21) Appl. No.: 17/272,168

(22) PCT Filed: Aug. 23, 2019

(86) PCT No.: PCT/US2019/047849
§ 371 (c)(1),
(2) Date: Feb. 26, 2021

(87) PCT Pub. No.: WO2020/046735
PCT Pub. Date: Mar. 5, 2020

(65) Prior Publication Data

US 2021/0214825 A1 Jul. 15, 2021

Related U.S. Application Data

(60) Provisional application No. 62/724,572, filed on Aug. 29, 2018.

(51) Int. Cl.
*C22C 38/58* (2006.01)
*C21D 1/18* (2006.01)
(Continued)

(52) U.S. Cl.
CPC ..... *C22C 38/58* (2013.01); *C21D 1/18* (2013.01); *C21D 1/26* (2013.01); *C21D 6/004* (2013.01);
(Continued)

(58) Field of Classification Search
CPC ..... C22C 38/58; C22C 30/00; C22C 38/001; C21D 1/18; C21D 1/26; C21D 6/004; C21D 6/005; C21D 8/005; C21D 2211/001
See application file for complete search history.

(56) References Cited

U.S. PATENT DOCUMENTS 3,947,266 A 3/1976 Culling
4,278,465 A 7/1981 Culling
(Continued)

FOREIGN PATENT DOCUMENTS

DE 3508532 A1 9/1986
EP 0657556 A1 6/1995
JP H05070892 A * 3/1993 ..... C22C 19/05

OTHER PUBLICATIONS

Espacenet machine translation of JPH05070892 (Year: 2022).*
(Continued)

*Primary Examiner* — Ricardo D Morales
(74) *Attorney, Agent, or Firm* — Seed Intellectual Property Law Group LLP

(57) ABSTRACT

Austenitic stainless alloys have been discovered that exhibit unexpectedly superior corrosion resistance, particularly to sulfuric acid solutions, when compared to that exhibited by conventional alloys with closely related compositions. These alloys advantageously are corrosion resistant to a relatively wide range of sulfuric acid concentration and temperature and are thus particularly suitable for use in the industrial production of sulfuric acid.

6 Claims, 2 Drawing Sheets

(51) Int. Cl.

| | |
|---|---|
| ***C21D 1/26*** | (2006.01) |
| ***C21D 6/00*** | (2006.01) |
| ***C21D 8/00*** | (2006.01) |
| ***C22C 30/00*** | (2006.01) |
| ***C22C 38/00*** | (2006.01) |

(52) U.S. Cl.

CPC ..... *C21D 6/005* (2013.01); *C21D 8/005* (2013.01); *C22C 30/00* (2013.01); *C22C 38/001* (2013.01); *C21D 2211/001* (2013.01)

(56) References Cited

U.S. PATENT DOCUMENTS

| | | | |
|---|---|---|---|
| 4,543,244 | A | 9/1985 | Jones et al. |
| 5,028,396 | A | 7/1991 | Jones et al. |
| 5,151,248 | A | 9/1992 | Ebara et al. |
| 5,695,716 | A | 12/1997 | Köhler et al. |
| 6,036,917 | A | 3/2000 | Sorace et al. |
| 2002/0141897 | A1 | 10/2002 | Ernst et al. |

OTHER PUBLICATIONS

Francis, Roger, "The performance of stainless steels in concentrated sulphuric acid", Nov. 2009, Stainless Steel World, pp. 1-4.

VDM Alloy 33, "Nicrofer 3033", Mar. 2000, Material Data Sheet No. 4042, pp. 1-12.

* cited by examiner

AUSTENITIC STAINLESS ALLOY WITH SUPERIOR CORROSION RESISTANCE

TECHNICAL FIELD

The present invention pertains to austenitic stainless alloys and methods of making same for use in applications requiring high corrosion resistance. The stainless alloys are particularly suitable for applications involving exposure to high temperature, concentrated sulfuric acid such as industrial sulfuric acid production.

BACKGROUND

Stainless steels are alloys of steel and a significant amount of chromium (e.g. greater than 10% by weight Cr). They typically provide substantially superior resistance to corrosion than other types of steel in commonly encountered corrosive environments. Stainless steel alloys are thus frequently employed in applications where corrosion resistance is important. An extensive number of different alloys have been developed in the art, all offering certain advantages and disadvantages for specific intended applications. These alloys may comprise numerous alloying elements other than chromium and in a myriad number of combinations. Stainless steel alloys are generally classified into one of several groups based on their crystal structure. These groups include austenitic, ferritic, martensitic, and duplex types of stainless steels. The structure of an austenitic stainless steel is face-centered cubic.

Sulfuric acid is one of the most produced commodity chemicals in the world and is widely used in the chemical industry and commercial products. Generally, production methods involve converting sulfur dioxide first to sulfur trioxide, which is then later converted to sulfuric acid. In 1831, P. Phillips developed the contact process which is used to produce most of today's supply of sulfuric acid. While efficient and economical, challenges exist in constructing suitable industrial production plants due to the highly corrosive conditions involved.

The basics of the contact process involve obtaining a supply of sulfur dioxide (e.g. commonly obtained by burning sulfur or sulfur containing compounds, or by collecting metallurgical off gases) and then oxidizing the sulfur dioxide with oxygen in the presence of a catalyst (typically vanadium oxide) to accelerate the reaction in order to produce sulfur trioxide. The reaction is reversible and exothermic and it is important to appropriately control the temperature of the gases over the catalyst in order to achieve the desired conversion without damaging the contact apparatus which comprises the catalyst.

Then, the produced sulfur trioxide is absorbed into a concentrated sulfuric acid solution to form stronger sulfuric acid, or oleum, which is then diluted to produce another concentrated sulfuric acid solution. This avoids the consequences of directly dissolving sulfur trioxide into water which is a highly exothermic reaction.

While the fundamentals of the contact process are relatively simple, it is desirable to maximize the conversion of sulfur dioxide into sulfuric acid. Thus, modern plants for producing sulfuric acid often involve more than one absorption stage to improve conversion and absorption. Commonly, a double absorption process is employed in which process gases are subjected to two contact and absorption stages in series, (i.e. a first catalytic conversion and subsequent absorption step followed by a second catalytic conversion and absorption step). Details regarding the conventional options available and preferences for sulfuric acid production and the contact process are well known and can be found for instance in "Handbook of Sulfuric Acid Manufacturing", Douglas Louie, ISBN 0-9738992-0-4, 2005, published by DKL Engineering, Inc., Ontario, Canada.

In order to handle the high concentrations and temperatures involved in the typical production of sulfuric acid, special corrosion resistant alloys must be employed in the process equipment. Notwithstanding their superior corrosion resistance, even these special alloys may be inadequate in certain situations. This is because even relatively small seeming changes in concentration and temperature under these severe conditions can markedly increase the rate of corrosion. Specifically, small decreases in sulfuric acid concentration and/or small increases in sulfuric acid temperature outside the normal required operating conditions can result in substantially greater corrosion rates. These are very tight operating ranges (e.g. concentration and temperature ranges of 99.2-99.6% and 210-225° C. respectively) and it can be difficult to control consistently. Many plants have been destroyed in the past when a loss of control occurred (known as a "plant upset"). Further, plants have also been heavily damaged and/or corroded, either due to upsets, mal operation, or simply pushing the plants are outside safe operating conditions. Resistance to such concentration and temperature upsets would thus be very beneficial.

It is also desirable to minimize the energy requirement in the industrial production of sulfuric acid. In the numerous processes involved, there are substantial sources and requirements for heat. Energy efficiency can desirably be improved with the use of complex heat exchanger arrangements to maximize energy recovery. The desire to do so however results in a demand for higher operating temperatures and a corresponding greater demand for corrosion resistant materials.

For instance, in U.S. Pat. No. 4,576,813, a method and apparatus was disclosed for significantly improving the efficiency of plants that used the double absorption process. A heat recovery system was disclosed that raised the temperature at which the absorption of sulfur trioxide takes place in the intermediate adsorption stage. By operating at these higher temperatures, the heat of absorption and dilution can be used to generate useful steam instead of rejecting the heat to a cooling tower. Overall efficiency could thus be substantially improved. However, at these higher temperatures, prior art materials of construction were subject to substantially greater corrosion rates. In order to enable the method commercially, both greater sulfuric acid concentrations and different, specially selected alloys had to be employed in order that the apparatus was suitably resistant to corrosion at these greater temperatures.

Alloy 310S stainless steel is a high chromium, high nickel, austenitic stainless steel that has superior corrosion resistance to sulfuric acid under such conditions when compared to 304 or 316 grade stainless steel. It has found much commercial use in industrial acid production. However, it is not so corrosion resistant when the sulfuric acid concentration falls below 99%. Many plants based on 310S alloy have been destroyed due to plant upsets and loss of control.

Certain stainless steels with high silicon content are considered desirable for use in industrial sulfuric acid production. A range of such stainless steel alloys have been disclosed for instance in U.S. Pat. Nos. 4,543,244 and 5,028,396. SARAMET® alloy is a high silicon containing, austenitic stainless steel that was introduced commercially in 1982 for use in hot sulfuric acid. The high silicon content provides alloys with good resistance to concentrated sulfuric acid at high flow velocities. However, such alloys are generally less resistant to corrosion in oleum when compared to 310S stainless steel.

Other high silicon, corrosion resistant, austenitic stainless steel alloys that are particularly well suited for use in an acidic environment, e.g. concentrated sulfuric acid, were disclosed in U.S. Pat. No. 6,036,917. The alloys therein had a composition, by weight, of about 0.025% or less carbon, about 0.5 to about 4.1% manganese, about 5.5 to about 6.2% silicon, about 11 to about 15% chromium, about 9.0 to about 15.5% nickel, about 0.8 to about 1.2% molybdenum and about 0.8 to about 2% copper and the remainder being essentially iron with incidental impurities. This composition results in lean alloy content in a high silicon austenitic stainless steel for concentrated sulfuric acid service while maintaining a corrosion rate similar to and competitive with existing alloys for such service. Acceptable characteristics were found when hot working was carried out in the range of about 2100° F. to about 2200° F. Annealing in the range of about 1925° F. to about 2025° F. is preferred, as is rapid water quenching after annealing.

In U.S. Pat. No. 5,695,716, a wide range of different high chromium, austenitic stainless alloys were disclosed for providing improved resistance to corrosion. Although these alloys have a high chromium content, they were disclosed as being easily workable nonetheless. They have only a low molybdenum content or contain no molybdenum and unexpectedly have high corrosion resistance in hot, oxidizing acids. Further, alloys with 0.5 to 2 wt % Mo and 0.3 to 1 wt % Cu were disclosed as being preferred. Also preferred were various austenitic alloys whose Ni content was at or below 32.0 wt % and whose Mn content was at or below 1.0 wt %.

A commercially available specialty alloy that may be considered for use in industrial sulfuric acid production is Nicrofer® 3033-alloy 33. This is a high-chromium, high-nickel molybdenum and copper containing austenitic alloy and offers high resistance to corrosion in highly oxidizing media.

Yet another commercially available specialty alloy that may be considered for use in industrial acid production, and particularly those with improved efficiency, heat recovery subsystems is Zeron®100 (UNS S32760). This is a super duplex stainless alloy promoted for use in sulfuric acid manufacturing applications at elevated temperatures up to 200° C.

The list of known stainless steel alloys and stainless alloys is quite diverse and advanced. And the requirements for the commercial production of sulfuric acid have long been known. Still, there remains a desire for materials with ever greater corrosion resistance in order to allow for expanded operating ranges and to make more robust processing equipment.

SUMMARY

The present invention addresses these needs by providing stainless compositions and methods of making the same that are surprisingly more resistant to corrosion than closely related compositions. Austenitic stainless alloys in a certain narrow compositional range have demonstrated unexpectedly superior corrosion resistance, particularly to hot, concentrated sulfuric acid solutions. Such alloys are thus particularly useful for the industrial production of sulfuric acid.

Specifically, the improved austenitic stainless alloys are characterized by the following composition in weight %:

36-40% chromium
32.5-36% nickel
1.5-2.0% manganese
0.35-0.6% nitrogen
<0.3% silicon
<0.02% carbon
<0.02% phosphorus
<0.04% molybdenum
<0.02% copper
<0.005% sulfur
remainder consisting essentially of iron.

In particular, stainless alloys characterized by compositions in the ranges of 36-37% chromium, 32.5-34% nickel, 1.65-1.75% manganese, and 0.37-0.47% nitrogen are approximately the same as an embodiment in the Examples below which demonstrated unexpected superior corrosion resistance to very harsh sulfuric acid conditions. In addition, stainless alloys characterized by compositions in the ranges of 38-40% chromium, 34.5-36% nickel, 1.55-1.65% manganese, and 0.38-0.48% nitrogen are approximately the same as another embodiment in the Examples below which demonstrated similar superior corrosion resistance to very harsh sulfuric acid conditions. That is, stainless alloys whose compositions are within plus or minus 1% of the Cr and Ni content and within plus or minus 0.05% of the Mn and N content of these embodiments are considered to be approximately the same compositionally. And further, stainless alloys characterized by compositions within the ranges of these embodiments (i.e. from 36-40% chromium, 32.5-36% nickel, 1.55-1.75% manganese, and 0.37-0.48% nitrogen) are also expected to exhibit similar superior corrosion resistance to very harsh sulfuric acid conditions. Alloys of the invention are further characterized by features inherently appearing as a result of being hot worked, solution annealed, and quenched.

A method for making the aforementioned austenitic stainless alloys comprises the general steps of: obtaining sources of chromium, nickel, manganese, nitrogen, and iron in a selected ratio; vacuum induction melting the metallic sources thereby forming a molten mixture; casting the molten mixture thereby creating a solid precursor alloy; hot working the solid precursor alloy; solution annealing and quenching the solid precursor alloy thereby creating a quenched alloy; and removing heavy oxide scale from the quenched alloy thereby creating the austenitic stainless alloy.

In exemplary embodiments of the method, the casting step can be performed in air. Further, the solution annealing step can be done at greater than or equal to 1150° C. Still further, the method can optionally include cold working the solid precursor alloy (e.g. after hot working, annealing, and quenching). And the step of removing heavy oxide scale step can preferably comprise pickling the quenched alloy.

The austenitic stainless alloys of the invention can be used to advantage in numerous applications. However, the alloys are particularly suitable for use in components exposed to high temperature, concentrated solution of sulfuric acid specifically in which the temperature of the solution is greater than or equal to 175° C. and the average concentration of sulfuric acid in the solution is greater than or equal to 98% (including oleum or fuming sulfuric acid in which the concentration is >100%). Exemplary alloys of the invention have shown superior resistance to corrosion in sulfuric acid solution whose temperature is in the range from 175° C. to 265° C. and/or whose concentration is in the range from 98% to 99.5%. Such alloys may therefore advantageously be used as components in part of an industrial sulfuric acid production plant, and particularly in part of a steam generating system in such a production plant. The components can for instance be wrought or cast products of the austenitic stainless alloys.

DETAILED DESCRIPTION

Figure 1:
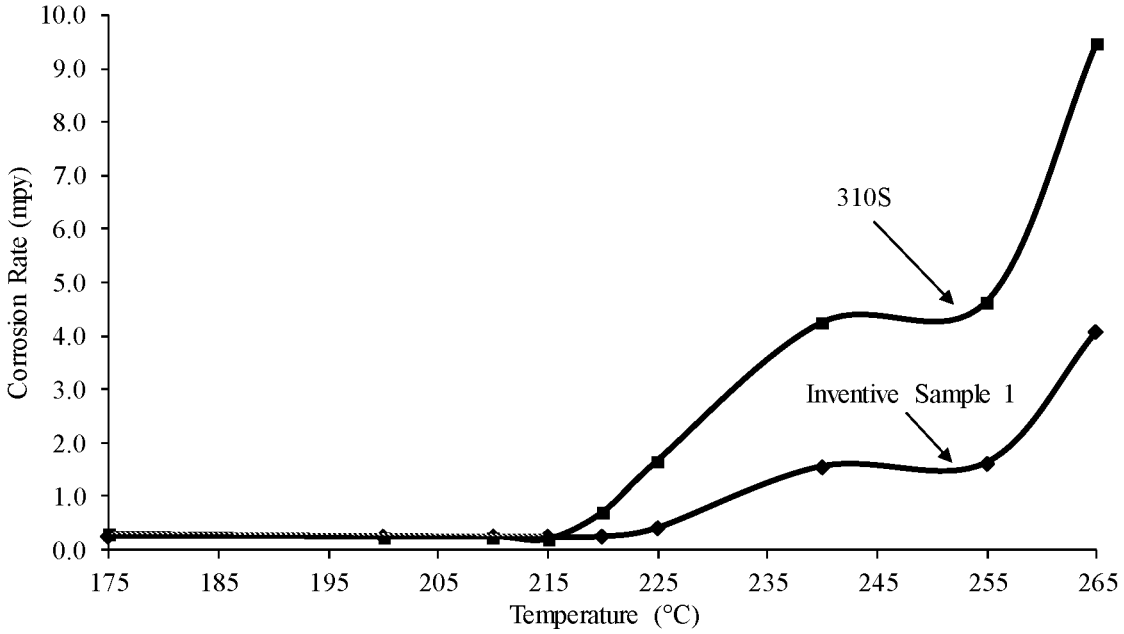
FIG. 1 compares the corrosion rates of Inventive Sample 1 to those of commercial 310S when exposed to 99.5% $H_2SO_4$ at temperatures ranging from 175° C. to 265° C.

Unless the context requires otherwise, throughout this specification and claims, the words "comprise", "comprising" and the like are to be construed in an open, inclusive sense. The words "a", "an", and the like are to be considered as meaning at least one and not limited to just one.

"Stainless alloy" refers to an alloy comprising at least chromium, nickel, and iron with a minimum of 10.5% chromium content by mass.

Herein, an "austenitic stainless alloy" is a stainless alloy primarily characterized as having an austenite crystalline structure (i.e. face centered cubic). While commonly known austenitic stainless steels contain from about 16 to 25% chromium, herein austenitic stainless alloys can include greater amounts of chromium (e.g. up to 40%).

Also herein, the term "sulfuric acid solution" refers to those solutions or compositions commonly known in the industry as sulfuric acid solutions. Thus, along with $H_2SO_4$ solutions up to 100% in concentration, the term is additionally intended to include oleum and/or fuming sulfuric acid which are compositions considered to be greater than 100% in concentration. In the industry, sulfuric acid solutions may be considered to be solutions of sulfur trioxide or $SO_3$ in water and can be described for instance as $ySO_3 \cdot H_2O$. Oleum or fuming sulfuric acid refers to compositions in which y is greater than 1 (e.g. excessive sulfur trioxide is present). Such compositions may also be expressed in terms of a percentage of sulfuric acid strength, namely as a sulfuric acid solution whose concentration is greater than 100%. Such compositions are routinely encountered in the industrial production of sulfuric acid.

Alloys of the invention are austenitic stainless alloys comprising chromium, nickel, manganese, nitrogen, and iron in specially selected ratios that result in surprisingly superior corrosion resistance characteristics. In particular, the composition of these stainless alloys is chosen to obtain superior corrosion resistance in strongly oxidizing, acidic, liquid chemical environments such highly concentrated, hot sulfuric acid. However, the alloys also have potential to work very well in high temperature oxidizing furnace gas.

The elemental composition of the austenitic stainless alloys in weight % is:

36-40% chromium
32.5-36% nickel
1.5-2.0% manganese
0.35-0.6% nitrogen
<0.3% silicon
<0.02% carbon
<0.02% phosphorus
<0.04% molybdenum
<0.02% copper
<0.005% sulfur
with the remainder consisting essentially of iron.

As illustrated in the Examples below, alloy samples comprising chromium, nickel, manganese, and iron at the low end of these ranges clearly show markedly improved corrosion resistance under harsh sulfuric acid conditions compared to preferred conventional stainless materials. Further, it is generally expected that workable stainless alloys may be prepared with modestly greater amounts of these elements (e.g. up to about 10% more of the major elements Cr and Ni and even slightly more of the minor elements Mn and N) and that, generally, the increased amount of these elements would result in additional improvement. This is evidenced by an alloy sample in the Examples comprising chromium and nickel at the high end of these ranges and which also appears to show similar improved corrosion resistance.

Without being bound by theory, the presence of high levels of chromium in the alloy, while otherwise maintaining a high level of alloy purity so as to prevent degradation of the influence of the chromium, is believed to provide the alloy's resistance to oxidizing chemicals. Such chromium levels, in combination with the specified nickel content, are considered to be about the highest available so as to obtain a workable and weldable wrought stainless alloy. The high Cr content gives the inventive alloys improved resistance to hot acid corrosion over known and traditionally used materials, while also giving them economy over conventional, higher nickel alloys. Further, the higher the Cr level in the alloy of the invention, the higher the expected corrosion resistance will be.

The nickel content of the alloy extends the stability of the austenitic structure and, along with the amount of incorporated nitrogen, allows for the inclusion of the required large amount of chromium in the alloy, without losing other important alloy characteristics like strength, weldability and workability. Increasing Ni content stabilizes the alloy structure with increasing Cr content and helps to prevent segregations and internal precipitations inside the material and welds of the material, thereby assisting in production, fabrication and improving corrosion resistance. (Segregations deplete tiny localized areas of key reactive elements, e.g. Cr, thereby decreasing corrosion resistance). Reasonable increases in Ni content are expected to provide improved results. However, too much Ni can be detrimental because Ni has a high affinity for sulfur and in hot, aggressive sulphuric acid environments this can stimulate unwanted corrosion. Thus, only enough Ni is desirable so as to achieve the inclusion of the desired high amount of Cr. An advantage of reduced Ni content is better economy.

Manganese is required in the alloy making process and the presence of Mn helps to reduce the amount of Ni required, stabilizes the alloy structure, promotes material uniformity, retards segregations and precipitations from forming, and controls impurities. Mn also assists in hot processing and scavenges impurities. The presence of nitrogen in the alloy also assists in reducing the amount of Ni required. Further, nitrogen retards unwanted chemical reactions from taking place in the material during production and fabrication. Mn and nitrogen work independently and synergistically with Ni to keep the alloy structure stable and homogeneous, and prevent segregations and precipitations inside the material and its welds, aiding in manufacture, fabrication and improving corrosion resistance. Mn, Ni, and N also can work synergistically in the right amounts to promote uniformity and retard segregations, thus improving corrosion resistance in the same way Mo and Cu are synergistic, important alloy additions known to improve an alloy's corrosion resistance in reducing chemicals/environments. And even alone or in combination, Mo and Cu are known to improve an alloy's corrosion resistance to sulfuric acid. The corrosion resistance of the inventive alloys is surprising then, since it has been found that the inclusion of Mo and Cu is detrimental to corrosion performance. Alloys of the invention contain very little or essentially no Mo and Cu, and yet their corrosion resistance is outstanding in the highly oxidizing conditions experienced in high temperature, highly concentrated sulfuric acid. Unexpectedly then, Mo and Cu levels are thus desirably kept very low.

As for the other cited elements, i.e. Si, C, P, and S, these are considered as impurities and are present in very small quantities. In order to attain a desired alloy purity, these may be kept as low as practically possible, within controllable limits/variations, and except as required for the alloy making process.

A general method for making austenitic stainless alloys of the invention initially involves obtaining appropriate sources of chromium, nickel, manganese, nitrogen, and iron in a ratio selected to match that desired in the final alloy composition. These sources can be pure metals, combinations of metals or oxides; a higher percentage or pure metal raw material is preferred. Nitrogen may be incorporated as a gas, as an injected liquefied gas, and/or as complexes with other alloying element additions. The sources are then combined and melted via vacuum induction melting to form a molten mixture. The molten mixture is then cast thereby creating a solid precursor alloy. The casting can be done either in air or vacuum and either as ingot or continuous casting although ingot casting is preferred. Optionally the precursor alloy can be remelt refined via ESR (electro-slag remelting) or VAR (vacuum arc remelting) as an additional possible production step.

After casting, the precursor alloy is hot worked, such as by rolling, forging, or extruding. The alloy can also optionally be cold worked to dimension product pieces more precisely and/or to produce additional product forms by rolling and drawing complete with interstage annealing. The hot and optional cold working of the precursor alloy is then followed by solution annealing and quenching steps, thereby creating a quenched alloy. In the annealing step, a higher than typical annealing temperature (e.g. 1150° C.) helps to homogenize the material and put all the effective alloying elements in solid solution where they need to be in order to prevent corrosion. For quenching purposes, a water quenching step is preferred. Finally, the heavy oxide scale created on the quenched alloy is removed thereby creating the austenitic stainless alloy. For large pieces, the heavy oxide scale is preferably removed via a pickling procedure (an acid surface cleaning procedure e.g. using nitric-hydrofluoric acid mixtures at elevated temperatures). For small pieces, scale may alternatively be removed via sand blasting or "bright"/hydrogen atmosphere annealing.

Alloys of the invention have close to highest concentration of chromium and highest level of overall purity available in wrought alloy product forms. They are advantageous for use in pressure vessels and chemical plant equipment. Such alloys are highly corrosion resistant to concentrated nitric acid, high temperature oxidizing gases, and especially to high temperature, concentrated sulfuric acid. Thus, they are particularly suitable for use in sulfuric acid production but could also find application in nitric acid and in high temperature furnace gas service.

The present alloys provide longer service life, greater reliability, the potential for improved energy recovery/efficiency and greater flexibility in chemical plant operation. For instance, as discussed earlier, at the temperatures and concentrations involved in sulfuric acid production, even relatively small changes in concentration and temperature can markedly increase the rate of corrosion. Specifically, small decreases in concentration and/or small increases in temperature outside the normal required operating conditions can result in substantially greater corrosion rates. Thus, use of the present alloys may allow for acid at temperatures of 250° C. or greater to be used to generate higher pressure/quality steam (the present limit is about 210 to 225° C.). Also, reduced acid concentrations may be considered to provide for more efficient $SO_3$ absorption that can lead to process equipment size reductions. Greater operating flexibility and turndown possibilities for a given system design are created by allowing operation over wider temperature and acid concentration ranges. In addition to reduced corrosion benefits, some process and economic benefits can also be expected by increasing the viable operating window for acid strength and temperature beyond that conventionally used.

Of particular advantage in sulfuric acid production is a potential improvement against plant temperature and/or concentration upsets and loss of control. As mentioned earlier, many plants employing 310SS have been destroyed because of plant upsets and the massive corrosion that ensued. To avoid this, such plants must operate in very tight operating ranges (e.g. sulfuric acid concentrations between about 99.2 and 99.6% and temperatures between about 210 and 225° C.). However, controlling within these ranges can be difficult to do consistently with available instrumentation and operation error. As illustrated in the Examples below though, the corrosion resistance of the present stainless alloys is several times better than 310SS, and in some extreme cases, more than 30 times better. The present alloys may thus be acceptable for use under conditions representing major plant upsets or under conditions hitherto not believed possible (e.g. concentrations and temperatures of 98.5% and 250° C. respectively or of 98.5 to 99.5% and up to 265° C. respectively).

The following Examples have been included to illustrate certain aspects of the invention but should not be construed as limiting in any way.

EXAMPLES

In the following, inventive austenitic stainless alloys were prepared and their corrosion resistance characteristics were compared to those of certain commercial and prior art alloys specifically intended for use in applications involving exposure to sulfuric acid at high concentrations and temperatures (e.g. industrial sulfuric acid production plants).

A sample batch (denoted Inventive Sample 1) of an austenitic stainless alloy of the invention was made by obtaining sources of chromium, nickel, manganese, nitrogen, and iron in a ratio selected such that the weight % of Cr, Ni, Mn, and N in the product alloy would be at the lower ends of the ranges of inventive compositions. The sources were then melted using a vacuum induction technique and the resulting molten mixture was casted in air to form a solid precursor alloy. The precursor alloy was then hot worked, cold worked, solution annealed (at a temperature exceeding 1150° C.), and thereafter was quenched in water. Finally, oxide scale on the quenched alloy was removed by pickling.

The elemental composition of the inventive sample was determined using Inductively Coupled Plasma—Optical Emission Spectrometry (ASTM D1976 and E1086) and/or X-ray Fluorescence Analysis (JIS G 1256), Spark Spectrographic Analysis (JIS G 1253) and Combustion and Insert Gas Fusion Techniques (ASTM E1019). The results obtained appear in Table 1 below.

Samples of two commercially available stainless alloys commonly used in present-day sulfuric acid production plants were also obtained. These two alloys were premium 310S stainless steel (UNS S31008) and specialty stainless steel VDM® Alloy 33 (Nicrofer 3033). The compositions of these commercial alloys also appear in Table 1.

For further comparison purposes, the corrosion resistance of certain stainless alloys reported on in U.S. Pat. No. 5,695,716 were considered below. These alloys are closely related in composition to those of the present invention and were also specifically intended for use in applications involving exposure to sulfuric acid at high concentrations and temperatures. The compositions of these alloys as reported on in U.S. Pat. No. 5,695,716 also appear in Table 1.

TABLE 1

Compositions of various samples

| Element | Inventive Sample 1 (%) | Commercial premium 310S* (%) | Commercial Alloy 33** (%) | Comparative Sample 4' *** (%) | Comparative Sample 5' *** (%) |
|---|---|---|---|---|---|
| Cr | 36.01 | 25.49 | 31.0-35.0 | 35.46 | 36.4 |
| Ni | 32.95 | 19.32 | 30.0-33.0 | 31.65 | 31.7 |
| Mn | 1.70 | 1.36 | ≤2.0 | 0.74 | 0.73 |
| N | 0.4210 | 0.04 | 0.35-0.5 | 0.51 | 0.58 |
| Si | 0.20 | 0.43 | ≤0.5 | 0.03 | 0.04 |
| C | 0.017 | 0.04 | ≤0.015 | 0.012 | 0.012 |
| P | 0.009 | 0.022 | ≤0.020 | 0.004 | 0.002 |
| Mo | <0.02 | 0.15 | 0.5-2.0 | 0.11 | 0.1 |
| Cu | <0.02 | 0.19 | 0.3-1.2 | 0.01 | 0.01 |
| S | 0.0007 | 0.001 | ≤0.010 | 0.002 | 0.002 |
| Al | Not obtained | 0.019 | Not reported | 0.099 | 0.072 |
| Fe | Remainder | Remainder* | Remainder | Remainder | Remainder |

*Source: Mill certificate; also present were Co 0.38, Cb 0.013, Ti 0.004, Sn 0.008, Ta 0.007, Pb 0.001
**Source: VDM Metals GmbH data sheet March 2000
*** Source: US5695716

The corrosion characteristics of these samples was then determined when exposed to hot, concentrated sulfuric acid solutions at a variety of concentrations and temperatures representative of those experienced in commercial sulfuric acid production. In certain cases in the following, data was obtained from the literature. Otherwise, data was obtained by taking sample coupons approximately 8-10 $cm^2$ in area and about 6 mm thick and then exposing them to the indicated solutions for a period of 14 days or as otherwise indicated. Corrosion rates were then determined based on the loss of sample thickness as a result of this exposure. The corrosion rates are expressed as mils (thousandths of an inch) per year or mpy.

Comparisons to 310S

Figure 2:
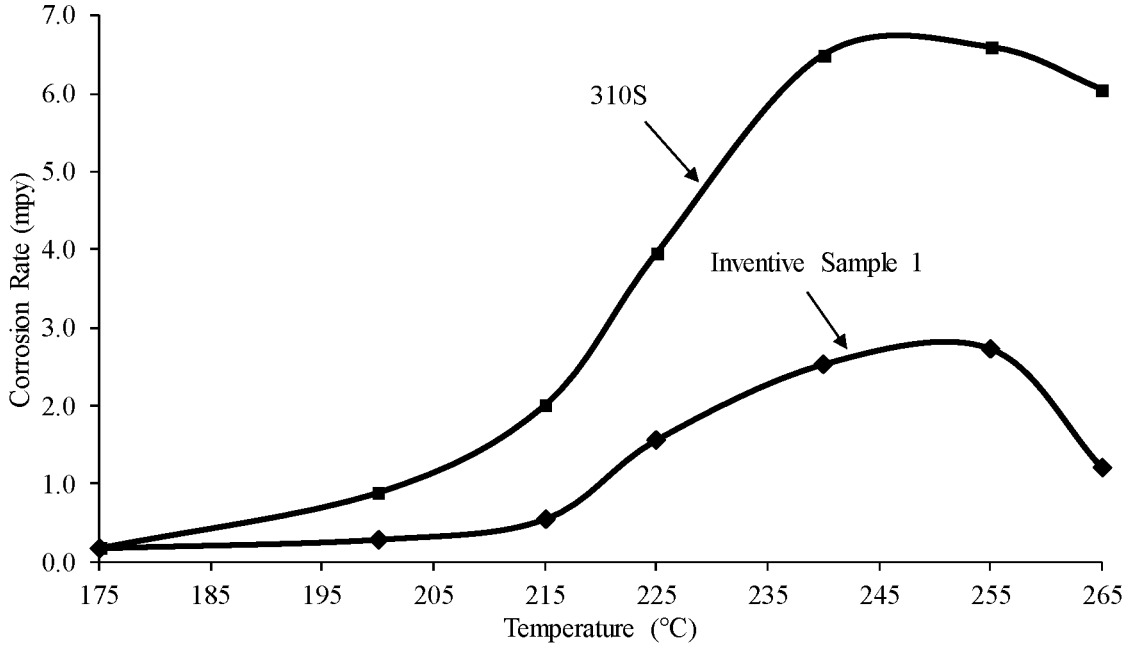
FIG. 2 compares the corrosion rates of Inventive Sample 1 to those of 310S when exposed to 99% $H_2SO_4$ at temperatures ranging from 175° C. to 265° C.
Figure 3:
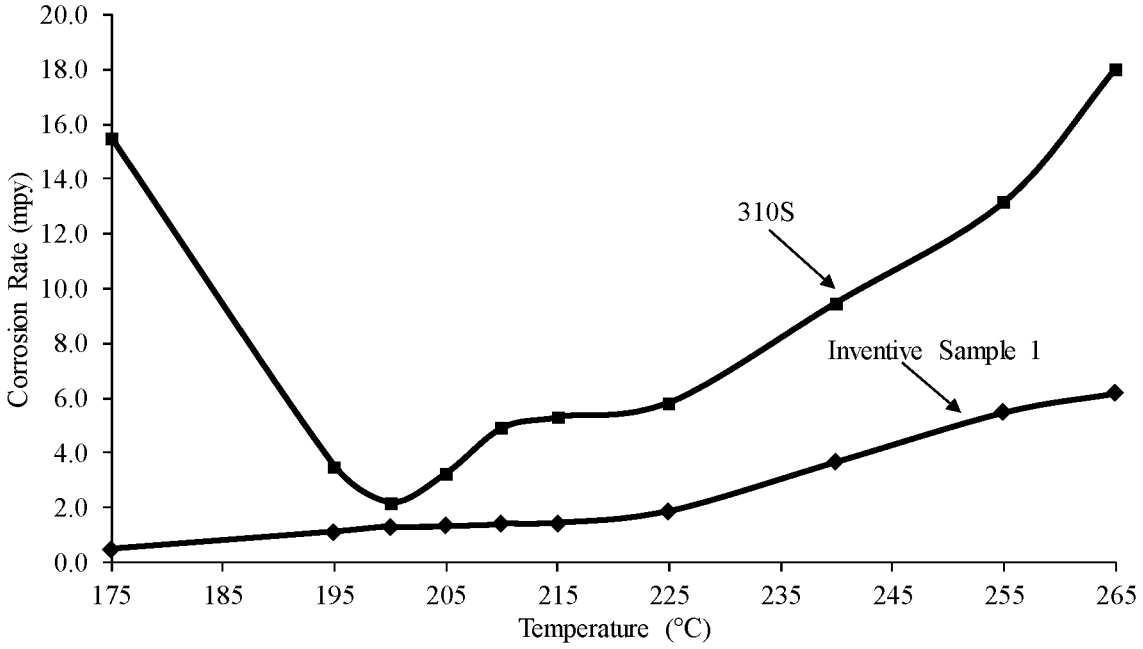
FIG. 3 compares the corrosion rates of Inventive Sample 1 to those of 310S when exposed to 98.5% $H_2SO_4$ at temperatures ranging from 175° C. to 265° C.
Figure 4:
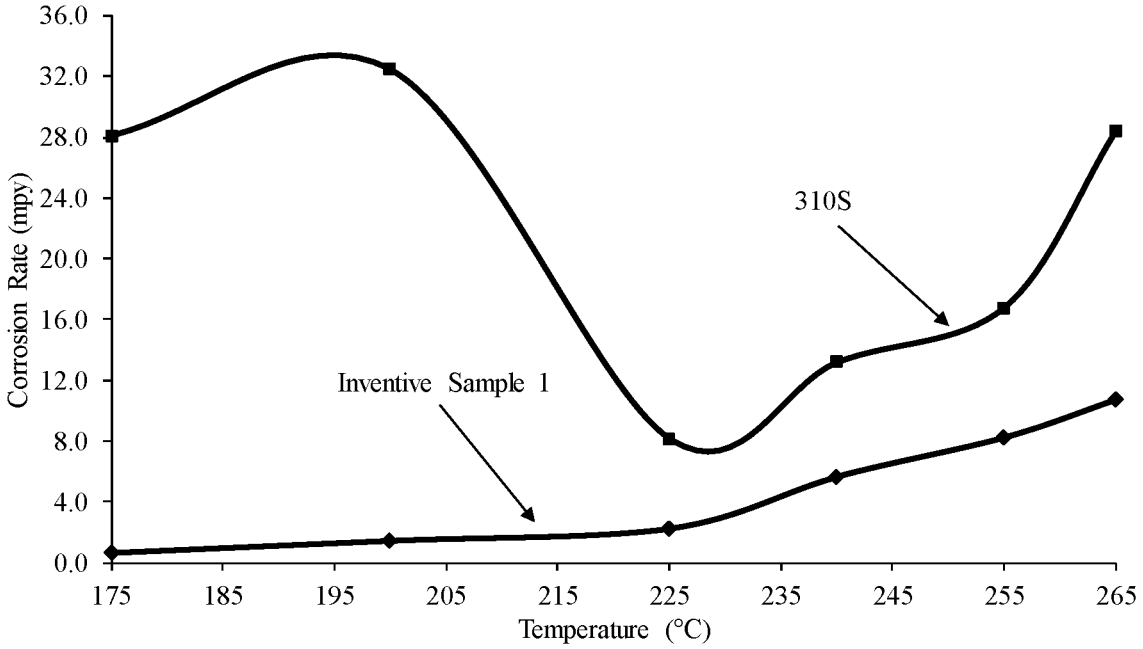
FIG. 4 compares the corrosion rates of Inventive Sample 1 to those of 310S when exposed to 98% $H_2SO_4$ at temperatures ranging from 175° C. to 265° C.

FIG. 1 compares the corrosion rates of Inventive Sample 1 to those of 310S (the current industry standard for such process environments) when exposed to 99.5% $H_2SO_4$ at temperatures ranging from 175° C. to 265° C. FIG. 2 compares the corrosion rates of Inventive Sample 1 to those of 310S when exposed to 99% $H_2SO_4$ at temperatures over the same range. FIG. 3 compares the corrosion rates of Inventive Sample 1 to those of 310S when exposed to 98.5% $H_2SO_4$ at temperatures over the same range. FIG. 4 compares the corrosion rates of Inventive Sample 1 to those of 310S when exposed to 98% $H_2SO_4$ at temperatures over the same range.

As is evident from the figures above, Inventive Sample 1 shows improved resistance to corrosion over commercial 310S over the entire temperature range tested. However, this is particularly so at the weaker acid strengths and higher temperatures tested where the corrosion characteristics of Inventive Sample 1 are markedly superior, sometimes being more than an order of magnitude better. It should be noted that these are ranges where the corrosion conditions are the most aggressive (i.e. at weaker acid strengths and/or higher temperatures).

Comparisons to Alloy 33

Table 2 below compares corrosion rates of Inventive Sample 1 to those of Alloy 33 when exposed to 99% $H_2SO_4$ at certain temperatures ranging from 155° C. to 265° C.

TABLE 2

Corrosion rates in 99% $H_2SO_4$ (in mpy)

| | Temperature | | | | | | | |
|---|---|---|---|---|---|---|---|---|
| Sample | 150° C. | 175° C. | 200° C. | 215° C. | 225° C. | 240° C. | 255° C. | 265° C. |
| Inventive Sample 1 | | 0.18 | 0.29 | 0.35 | 1.56 | 2.53 | 2.73 | 1.21 |
| Alloy 33* | 4.00 | 4.00 | 4.00 | | | | | |

*Data for Alloy 33 was obtained from Corrosion 53, 893-897 (2002)

Certain additional comparison data was obtained as summarized in Table 3 below. Here, the corrosion rates were determined for Inventive Sample 1 after exposure to the hot, concentrated acid for 14 days. In the case of Alloy 33, the rates were determined from an average of two results after exposure to the acid for 30 days.

TABLE 3

Additional corrosion rates in hot concentrated $H_2SO_4$ (in mpy)

| Sample | Concentration & temperature | | |
|---|---|---|---|
| | 98.5% & 200° C. | 98.5% & 215° C. | 99% & 200° C. |
| Inventive Sample 1 | | 1.42 | 0.29 |
| Alloy 33 | 5.30 | | |

The available data in the tables above show that Inventive Sample 1 has improved resistance to corrosion over commercial Alloy 33 and again suggests it is particularly superior at weaker acid strengths and higher temperatures (e.g. 98.5% and 215° C.).

Comparisons to alloys in U.S. Pat. No. 5,695,716

Table 4 below compares corrosion rates of Inventive Sample 1 to those provided for samples 4' and 5' in the aforementioned U.S. Pat. No. 5,695,716 (which are closely related in composition to those of the present invention). Data here is provided at closely related concentrations and temperatures as indicated.

TABLE 4

Corrosion rates in hot concentrated $H_2SO_4$ (in mpy)

| Sample | Concentration & temperature | | |
|---|---|---|---|
| | 215° C. for Inventive Sample 1 & 200° C. for others; all @ 98.5% | 99% for Inventive Sample 1 & 99.1% for others; all @ 175° C. | 99% for Inventive Sample 1 & 99.1% for others; all @ 200° C. |
| Inventive Sample 1 | 1.4 | 0.18 | 0.29 |
| Comparative Sample 4' | 4.7 | 2.4 | 1.2 |
| Comparative Sample 5' | 2.4 | 4.3 | 6.3 |

As can be seen from the data in Table 4 above, Inventive Sample 1 surprisingly shows markedly superior resistance to corrosion when compared to closely related samples from U.S. Pat. No. 5,695,716. Again, it should be noted that weaker acid strengths and higher temperatures are more aggressive corrosive conditions here. Thus, it is expected that the large differences already seen in corrosion rates between Inventive Sample 1 and the comparative samples would just be greater if the data were obtained under exactly the same acid concentrations and temperatures.

A second sample batch (denoted Inventive Sample 2) of an austenitic stainless alloy of the invention was made in a like manner to Inventive Sample 1 above except that the sources of chromium, nickel, manganese, nitrogen, and iron were obtained in a somewhat different ratio and thus the composition of the second sample batch was also somewhat different. The elemental composition of Inventive Sample 2 was determined as before and the results obtained appear in Table 5 below.

TABLE 5

Composition of Inventive Sample 2

| Element | Inventive Sample 2 (%) |
|---|---|
| Cr | 38.93 |
| Ni | 35.4 |
| Mn | 1.62 |
| N | 0.4300 |
| Si | 0.23 |
| C | 0.016 |
| P | 0.011 |
| Mo | 0.03 |
| Cu | 0.01 |
| S | 0.0004 |
| Al | Not obtained |
| Fe | Remainder |

As before, the corrosion characteristics of this sample were then determined when exposed to hot, concentrated sulfuric acid solutions at different concentrations and temperatures representative of those experienced in commercial sulfuric acid production. Data was obtained as described above by exposing coupons to the indicated solutions for a period of 14 days. Corrosion rates were again determined based on the loss of sample thickness as a result of this exposure (again in mils per year or mpy). Table 6 compares the corrosion rates of Inventive Sample 2 to those of 310S when exposed to two different sulfuric acid concentrations (i.e. 98.98% and 97.98% $H_2SO_4$) at a temperature ranging from 265° C. to 270° C. (a period of relatively minor temperature instability was experienced during testing such that the test temperature varied over this range) and to a 98.50% sulfuric acid concentration at 265° C.

TABLE 6

Corrosion rates in hot concentrated $H_2SO_4$ (in mpy) at 265° C. to 270° C.

| Sample | Concentration | | |
|---|---|---|---|
| | 98.98% | 97.98% | 98.50% |
| Inventive Sample 2 | 4.9 | 8.9 | 6.4 |
| 310S | 10.7 | 21.6 | 15.3 |

Inventive Sample 2 shows improved resistance results to corrosion that are similar to those obtained with Inventive Sample 1. Further, this demonstrates that alloys of the invention can be prepared with varied compositions over the claimed range and that they are characterized by unexpectedly superior corrosion resistance to hot concentrated sulfuric acid.

All of the above U.S. patents, U.S. patent applications, foreign patents, foreign patent applications and non-patent publications referred to in this specification, are incorporated herein by reference in their entirety.

While particular elements, embodiments and applications of the present invention have been shown and described, it will be understood, of course, that the invention is not limited thereto since modifications may be made by those skilled in the art without departing from the spirit and scope of the present disclosure, particularly in light of the foregoing teachings. Such modifications are to be considered within the purview and scope of the claims appended hereto.

The invention claimed is:

1. An austenitic stainless alloy comprising the following composition in weight %:

36-40% chromium;
32.5-36% nickel;
1.55-1.75% manganese;
0.37-0.48% nitrogen;
0.03-0.43% silicon;
<0.02% carbon;
<0.02% phosphorus;
<0.04% molybdenum;
<0.02% copper;
<0.005% sulfur; and
remainder consisting essentially of iron.

2. The alloy of claim 1 comprising the following composition in weight %:

36-37% chromium;
32.5-34% nickel;
1.65-1.75% manganese; and
0.37-0.47% nitrogen.

3. The alloy of claim 1 comprising the following composition in weight %:

38-40% chromium;
34.5-36% nickel;
1.55-1.65% manganese; and
0.38-0.48% nitrogen.

4. The alloy of claim 1 wherein the alloy is hot worked, solution annealed, and quenched.

5. An austenitic stainless alloy comprising the following composition in weight %:

36.01-38.93% chromium;
32.95-35.4% nickel;
1.62-1.70% manganese;
0.42-0.43% nitrogen;
0.03-0.43% silicon;
<0.02% carbon;
<0.02% phosphorus;
≤0.03% molybdenum;
<0.02% copper;
<0.005% sulfur; and
remainder consisting essentially of iron.

6. The alloy of claim 5, wherein the alloy is hot worked, solution annealed and quenched.

* * * * *